US011338420B2

(12) United States Patent
Lin

(10) Patent No.: US 11,338,420 B2
(45) Date of Patent: May 24, 2022

(54) POWDER ACTUATED NAIL GUN

(71) Applicants: Wang-Kuan Lin, Taichung (TW); Hsin Ho Manufacturing Co. Ltd., Taipei (TW)

(72) Inventor: Wang-Kuan Lin, Taichung (TW)

(73) Assignees: Wang-Kuan Lin, Taichung (TW); Hsin Ho Manufacturing Co. Ltd., Taipei (TW)

( * ) Notice: Subject to any disclaimer, the term of this patent is extended or adjusted under 35 U.S.C. 154(b) by 250 days.

(21) Appl. No.: 16/718,416

(22) Filed: Dec. 18, 2019

(65) Prior Publication Data

US 2021/0187714 A1 Jun. 24, 2021

(51) Int. Cl.
*B25C 1/00* (2006.01)
*B25C 1/08* (2006.01)

(52) U.S. Cl.
CPC ..... *B25C 1/008* (2013.01); *B25C 1/08* (2013.01)

(58) Field of Classification Search
CPC .... B25C 1/04; B25C 1/06; B25C 1/08; B25C 1/008; B25C 1/044; B25C 1/045; B25C 1/047; B25C 1/14; B25C 1/143; B25C 1/146
See application file for complete search history.

(56) References Cited

U.S. PATENT DOCUMENTS 3,115,636 A * 12/1963 Bernard ..... B25C 1/188 227/10
4,533,077 A * 8/1985 Jochum ..... B25C 1/14 173/90
5,881,940 A * 3/1999 Almeras ..... B25C 1/14 227/10
6,123,243 A * 9/2000 Pfister ..... B25C 1/14 227/10
6,808,100 B2 * 10/2004 Fielitz ..... B25B 27/0085 227/10
2004/0182335 A1 * 9/2004 Keller ..... B25C 1/14 123/46 H

* cited by examiner

*Primary Examiner* — Anna K Kinsaul
*Assistant Examiner* — Veronica Martin
(74) *Attorney, Agent, or Firm* — Alan D. Kamrath; Karin L. Williams; Mayer & Williams PC

(57) ABSTRACT

A powder actuated nail gun includes a body, a trigger unit, a nose assembly. The body includes a first tube and a second tube. A room is defined in the second tube. The nose assembly includes a nose, two balls, two pressing members, two resilient members, and a collar. The nose includes a base, a tubular portion and a passage. The base includes two recesses in which the two pressing members are received. The two balls are located in two elongate holes of the base. When the nose assembly is moved toward the grip, the balls are pressed between the pressing members and a strike rod in the nose so that the strike rod is co-moved with the nose assembly. The piston of the strike rod is moved to a ready-to-shoot position in the cylinder. The nail gun is able to shoot nails continuously.

10 Claims, 8 Drawing Sheets

POWDER ACTUATED NAIL GUN

BACKGROUND OF THE INVENTION

1. Fields of the Invention

The present invention relates to a nail gun, and more particularly, to a powder actuated nail gun.

2. Descriptions of Related Art

The conventional nail guns are required to be connected to an air compressor so as to introduce pressurized air into the nail gun and shoot nails from the nail guns. Another type of nail guns is powder actuated nail guns which do not need the air compressor and uses a controlled explosion created by a small chemical propellant charge to shoot nails into hard objects such as walls.

Before pulling the trigger to shoot nails, the powder actuated nail gun is required to point the nose of the nail gun upward to move the piston to the ready-to-use position, such that when pulling the trigger to activate the powder, the piston moves fast to shoot the nail out. If the users repeatedly pull the trigger, although the powder is activated, the exploration is not sufficient to shoot another nail. Therefore, the conventional powder activated nail gun has a low work efficiency.

The present invention is intended to provide a powder actuated nail gun that is designed to eliminate the drawbacks mentioned above.

SUMMARY OF THE INVENTION

The present invention relates to a powder actuated nail gun and comprises a body having a grip formed to the rear end thereof, and a trigger unit is connected to the body and the grip. A barrel is connected to the body, and a first tube is connected to the front end of the barrel of the body, and a second tube is connected to the first tube. A nose assembly axially extends through the second tube. The second tube has a threaded portion formed to the outer periphery thereof. The second tube includes a room formed therein, and the room communicates with an end hole defined in the front end of the second tube. The nose assembly includes a nose which is movably located in the room of the second tube. At least one ball is located in the nose, and at least one pressing member connected to the nose and presses the at least one ball. A resilient member is located on the outside of the at least one pressing member. A collar is mounted to the nose, and the resilient member is located in the inner periphery of the collar. A clip is connected to the nose to position the collar to the nose. The nose has a base which is movably and rotatably located in the room. The nose has a tubular member which movably and rotatably extends through the end hole of the second tube. A magazine is connected to the tubular member. A passage is defined axially through the tubular member and the baes. A strike rod movably extends through the passage. The strike rod includes a piston which is movably received in a cylinder located in the body. The base has at least one recess in which the at least one pressing member is received. At least one elongate hole is defined radially in the base and communicates with the passage. The at least one ball is located in the at least one elongate hole. A groove is defined in the outer periphery of the base and the clip is engaged with the groove. The at least one ball contacts the strike rod. When the nose assembly is moved toward the grip, the at least one ball is pressed between the at least one pressing member and the strike rod so that the strike rod is co-moved with the nose assembly, and the piston of the strike rod is moved to a ready-to-shoot position in the cylinder. Therefore, the nail gun can continuously shoot nails.

Preferably, the baes includes multiple bores defined in the end face thereof. An adjustment member is connected to a threaded hole defined in the front end of the second tube. The tubular member be connected to a magazine, and the adjustment member is engaged with one of the bores for restricting the rotational angle of the nose assembly in the second tube, and also controls the angle between the magazine and the body.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
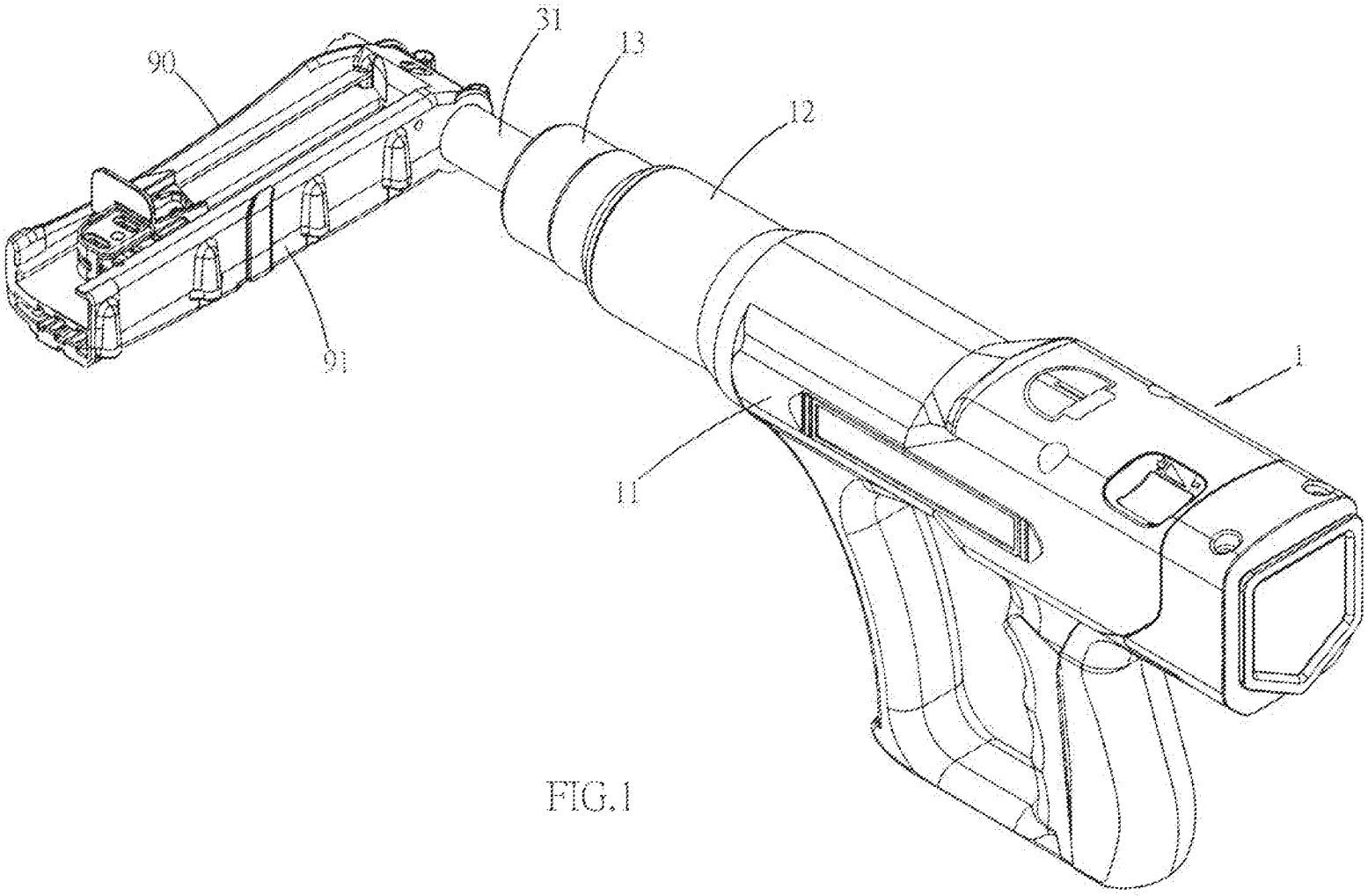
FIG. 1 is a perspective view to show the powder actuated nail gun of the present invention.
Figure 2:
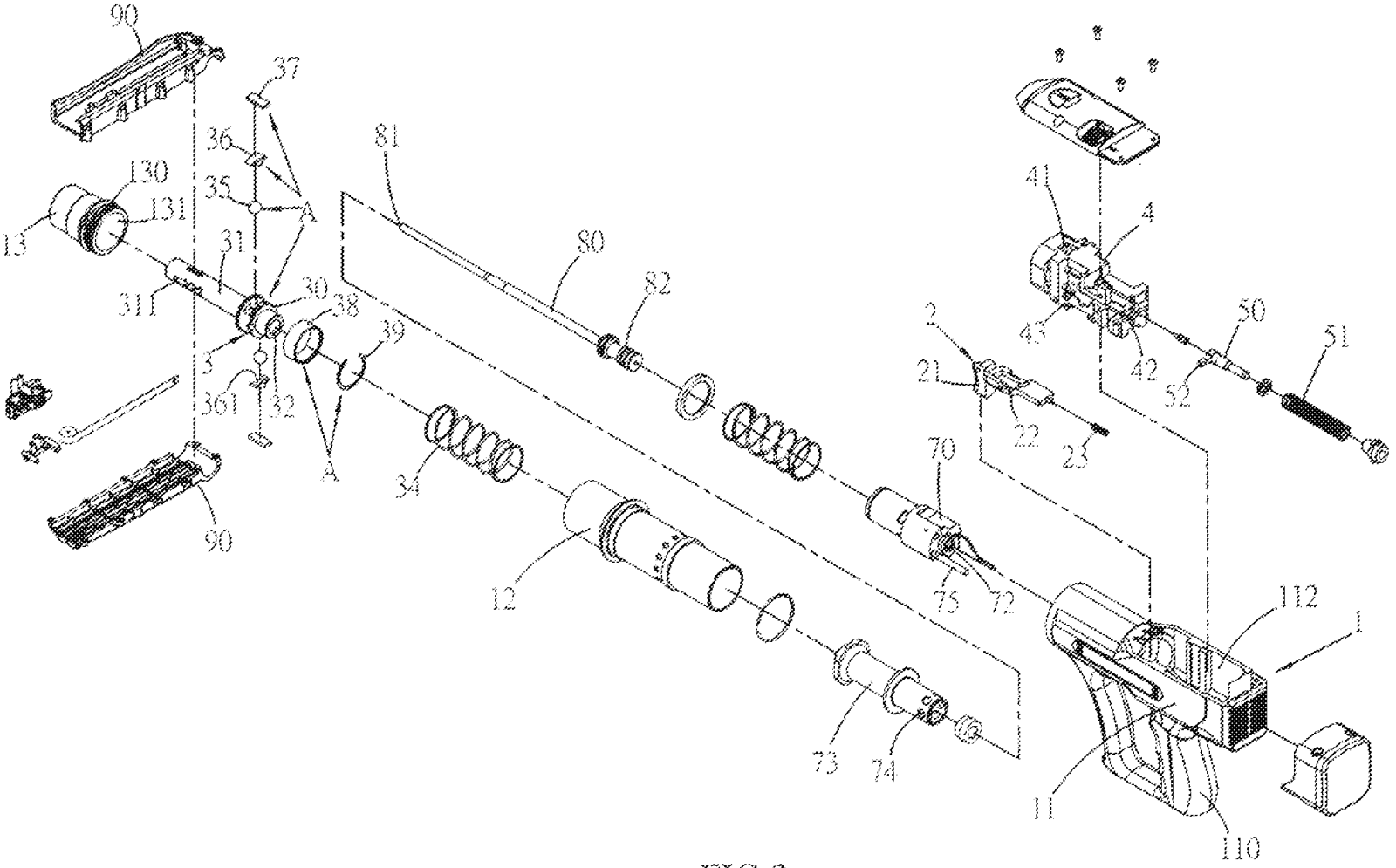
FIG. 2 is an exploded view of the powder actuated nail gun of the present invention.
Figure 3:
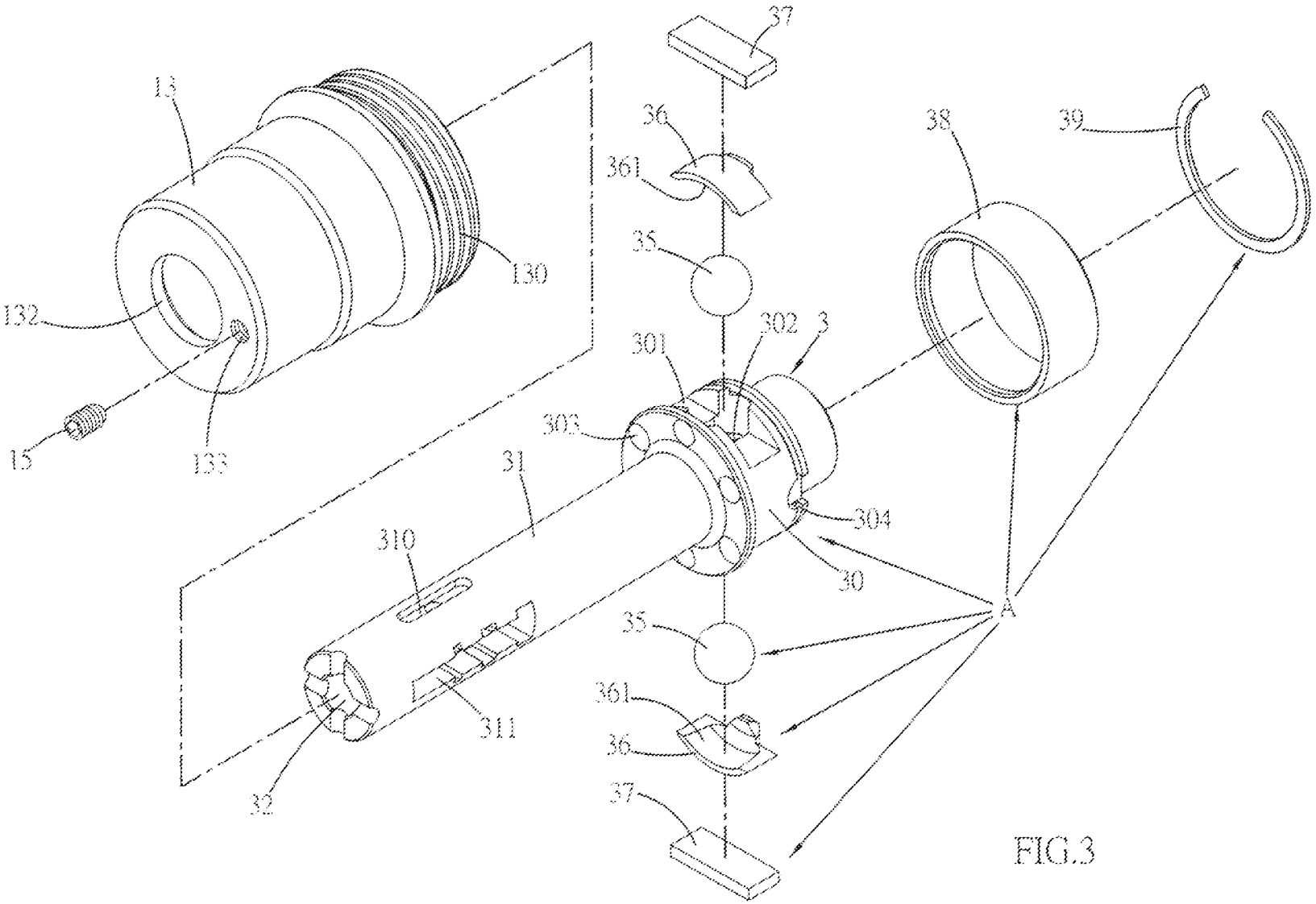
FIG. 3 is an exploded view of the nose assembly of the powder actuated nail gun of the present invention.

Referring to FIGS. 1 to 7, the powder actuated nail gun of the present invention comprises a body 1 having a grip 110 formed to the rear end thereof, and a trigger unit 2 is connected to the body 1 and the grip 110. A barrel 11 is connected to the body 1, and a first tube 12 is connected to the front end of the barrel 11 on the front end of the body 1. A second tube 13 is connected to the first tube 12. The barrel 11 includes a chamber 112 defined in the top thereof, and an actuation member 4 is received in the chamber 112. A nose assembly "A" axially extends through the second tube 13. The second tube 13 has a threaded portion 130 formed to the outer periphery thereof so as to be connected to the first tube 12, and the second tube 13 includes a room 131 formed therein which communicates with an end hole 132 defined in the front end of the second tube 13.

The trigger unit 2 includes a trigger 21, a push portion 22 and a spring 22. The trigger 21 protrudes beyond the grip and the spring 23 provides a return force to the trigger 21.

The nose assembly "A" includes a nose 3 which is movably located in the room 131 of the second tube 13. Two halls 35 are located in the nose 3. Two pressing members 36 are connected to the nose 3 and press the two balls 35. Two resilient members 37 respectively are located on outside of the two pressing members 36. A collar 38 is mounted to the nose 3 and the resilient members 37 are located in the inner periphery of the collar 38. A clip 39 is connected to the nose 3 and positions the collar 38 to the nose 3. The nose 3 has a base 30 which is movably and rotatably located in the room 131. The nose 3 has a tubular member 31 which movably and rotatably extends through the end hole 132 of the second tube 13. A magazine 90 is connected to the tubular member 31. A passage 32 is defined axially through the tubular member 31 and the base 30, and a strike rod 80 movably extends through the passage 32. The strike rod 80 includes a piston 82 which is movably received in a cylinder room 71 of a cylinder 70 located in the body 1. The base 30 has two recesses 301 in which the two pressing members 36 are received. An elongate hole 302 is defined radially in the base 30 and communicates with the passage 32. The balls 35 are located in the elongate hole 302. The two balls 35 partially protrude into the passage 32. A groove 304 is defined in the outer periphery of the base 30 and the clip 39 is engaged with the groove 304 to position the collar 38. The base 30 includes multiple bores 303 defined in one end face thereof. There are two balls 35, two pressing members 36 and two resilient members 37 located between the elongate hole 302 and the collar 38. The distance from the underside of one of two ends of the pressing member 36 to the inner bottom of the elongate hole 302 is longer than the distance from the underside of another one of the two ends of the pressing member 36 to the inner bottom of the elongate hole 302. In different embodiments, the underside of the pressing member 36 is an inclined underside 361 to form a thick portion and a thin portion. Alternatively, the elongate hole 302 includes a wide opening defined in the outer periphery of the base 30 and a narrow portion formed in the base 30, or the elongate hole 302 is not defined through the base 30, or the elongate hole 302 includes a tapered inner portion. The tubular member 31 has at least one positioning slot 310 which is connected with the magazine 90. The tubular member 31 has an entrance 311 for introducing nails 91 in the magazine 90 into the passage 32 of the tubular member 31. A spring 34 biases the base 30 of the nose 3 to keep the base 30 to contact the front end of the second tube 13 when the nose 3 is not applied by a force. An adjustment member 15 is connected to a threaded hole 133 defined in the front end of the second tube 13, the adjustment member 15 is engaged with one of the bores 303 for positioning the magazine 90 to the tubular member 31 of the nose 3. The adjustment member 15 is engaged with one of the bores 303 to restrict the rotational angle of the nose assembly "A" in the second tube 13, and also controls the angle between the magazine 90 and the grip 110 of the body 1. Therefore, the powder actuated nail gun of the present invention can be used in a narrow space.

The actuation member 4 in the chamber 112 includes a powder inlet 41, a reception recess 42 for receiving a firing pin, and a board 43. The powder inlet 41 receives a powder pack 410 inserted therein. The powder inlet 41 is perpendicular to the reception recess 42, and the reception recess 42 share a common axis with the first tube 12. The reception recess 42 has an elongate opening in which the board 43 is pivotable in the elongate opening. The board 43 has a portion which is pushed by the push portion 22 of the trigger unit 2. The board 43 includes an actuation portion which faces the elongate opening of the reception recess 42. The board 43 is pivoted and returns to its initial position by a torsion spring.

The firing pin 50 is axially movable and radially rotatable in the reception recess 42. The firing pin 50 is cooperated with a pre-compression resilient member 51 so that when the firing pin 50 moves backward, the pre-compression resilient member 51 is compressed to store energy.

A protrusion 52 is fixed to one side of the firing pin 50 and protrudes from the elongate opening of the reception recess 42. The protrusion 52 moves axially and pivoted radially in the elongate opening of the reception recess 42 to drive the firing pin 50. When the protrusion 52 is located at a pre-set backward position, it is located corresponding to the actuation portion of the board 43.

The cylinder 70 is axially movable in the first tube 12 and located close to the chamber 112 of the barrel 11. The cylinder 70 includes the cylinder room 71, a powder receiving port 72, a guide tube 73 and multiple exist holes 74. The powder receiving port 72 is located corresponding to the powder inlet 41.

A push rod 75 protrudes the end of the cylinder 70 that has the powder receiving port 62. The push rod 75 is co-moved with the movement of the cylinder 70, and the push rod 75 extends to the elongate opening of the actuation member 4. When the push rod 75 is set to be the backward status, the push rod 75 contacts the protrusion 52 to the pre-set backward position.

The strike rod 80 includes a hit end 81 and the piston 82. The hit end 81 is movable back and forth in the passage 32 of the nose 3, and the piston 82 is movable in the cylinder room 71 of the cylinder 70.

Figure 4:
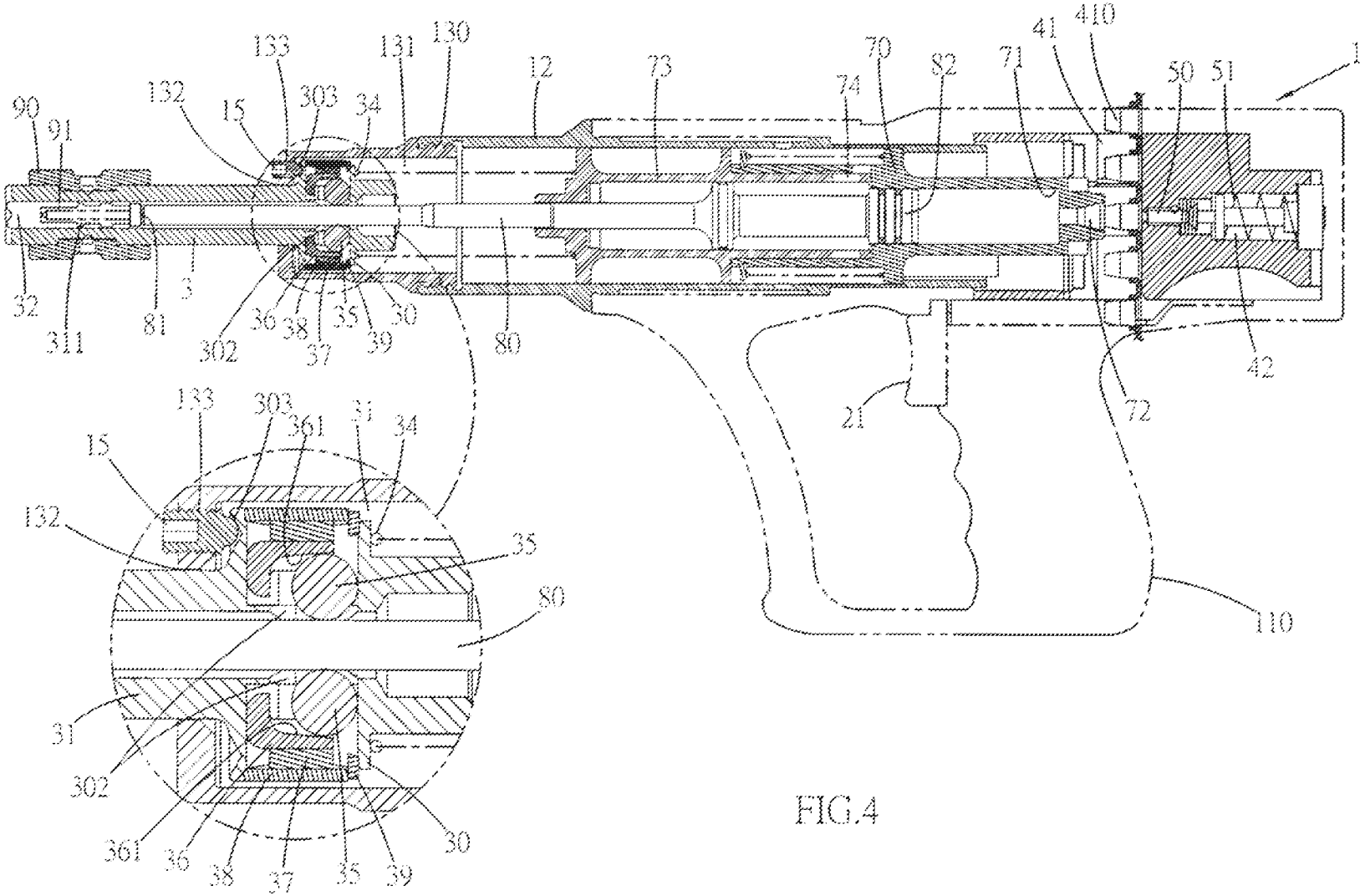
FIG. 4 is a side cross sectional view to show the powder actuated nail gun of the present invention.

As shown in FIG. 4, the nose 3 is pointed upward, the cylinder 70 and the push rod 75 are located at the pre-set forward position, and the protrusion 52 is located in different directions relative to the activation portion of the board 43. Even if the user pulls the trigger 21 to activate the board 43 to pivot, the activation portion of the board 43 cannot touch the protrusion 52, and there is no stored energy for the firing pin 50, so that the nails cannot shoot. This is a safety feature for the nail gun.

Figure 5:
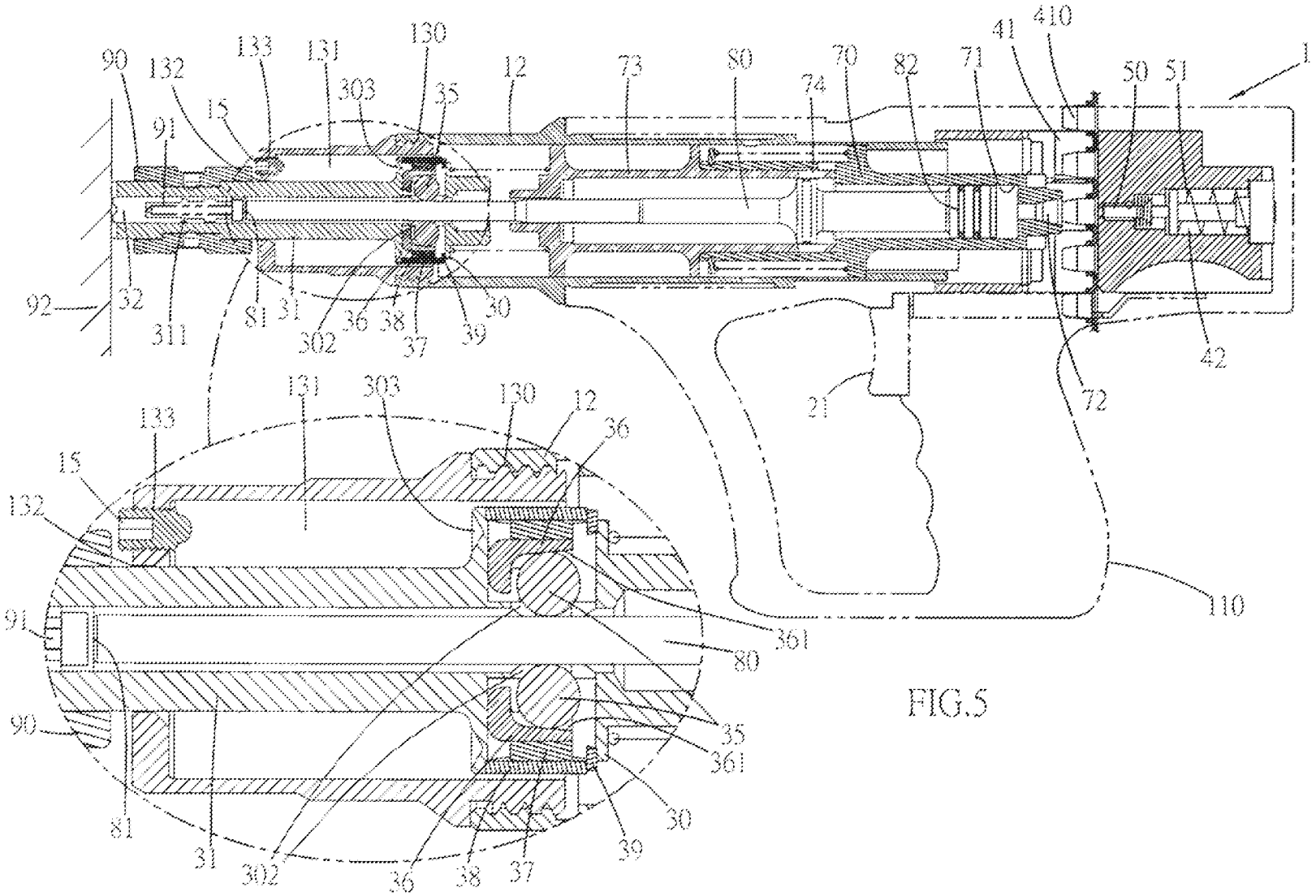
FIG. 5 is a side cross sectional view to show that the nose assembly the powder actuated nail gun of the present invention is retracted and moved toward the grip.

As shown in FIG. 5, when the tubular member 31 of the nose 3 contacts again the object 92 and is retraced toward right as shown, the collar 38, the pressing members 36, the resilient members 37 and the balls 35 are moved with the tubular member 31. The balls 35 in the elongate hole 302 partially protrude into the passage 32 and contact the strike rod 80, therefore, the balls 35 are no longer pressed by the pressing members 36. There is a gap or no contact between the balls 35 and the pressing members 36. The recesses 301 and the elongate hole 302 of the base 30 together with the pressing members 36 are moved toward the direction of the grip 110. Because t balls 35 that are not in contact with the pressing members 36, so that the balls 35 do not moved with the movement of the pressing members 36. When the balls 35 are located at the thick portion of the inclined underside 361 of the pressing members 36, and the strike rod 80 is pushed by the object 92, the balls 35 are pushed by the thick portion of the inclined underside 361 of the pressing members 36, and the balls 35 are clamped between the pressing members 36 and the strike rod 80. Therefore, the pressing members 36, the balls 35 and the strike rod 80 are together moved toward the direction of the grip 110, until the piston 82 of the strike rod 80 moves to the ready-to-shoot position in the cylinder room 71 of the cylinder 70.

Figure 6:
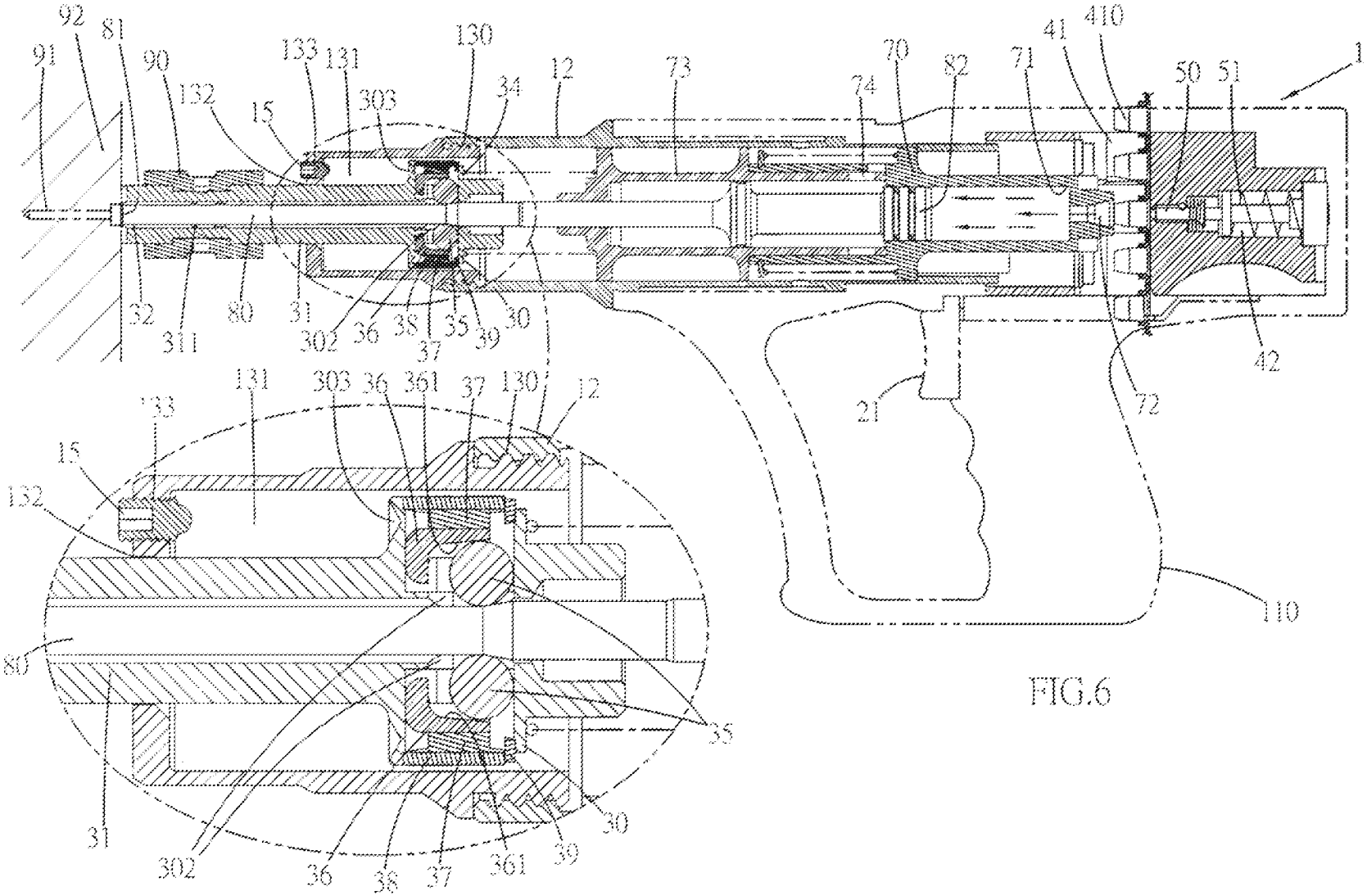
FIG. 6 is a side cross sectional view to show that the nose assembly the powder actuated nail gun of the present invention is activated to send a nail into an object.

As shown in FIG. 6, the user pulls the trigger 21 to pivot the board 43, the activation portion of the board 43 pushes the protrusion 52 of the firing pin 50 upward and the firing pin 50 shifts. The stored energy from the pre-compression resilient member 51 is suddenly released to let the firing pin 50 to hit the powder pack 410 to detonate the powder in the powder pack 410, and explosion of the powder moves the piston 82 via the powder receiving port 72 so that the strike rod 80 moves and the hit end 81 shoots the nail 91 in the passage 32 into the object 92.

Figure 7:
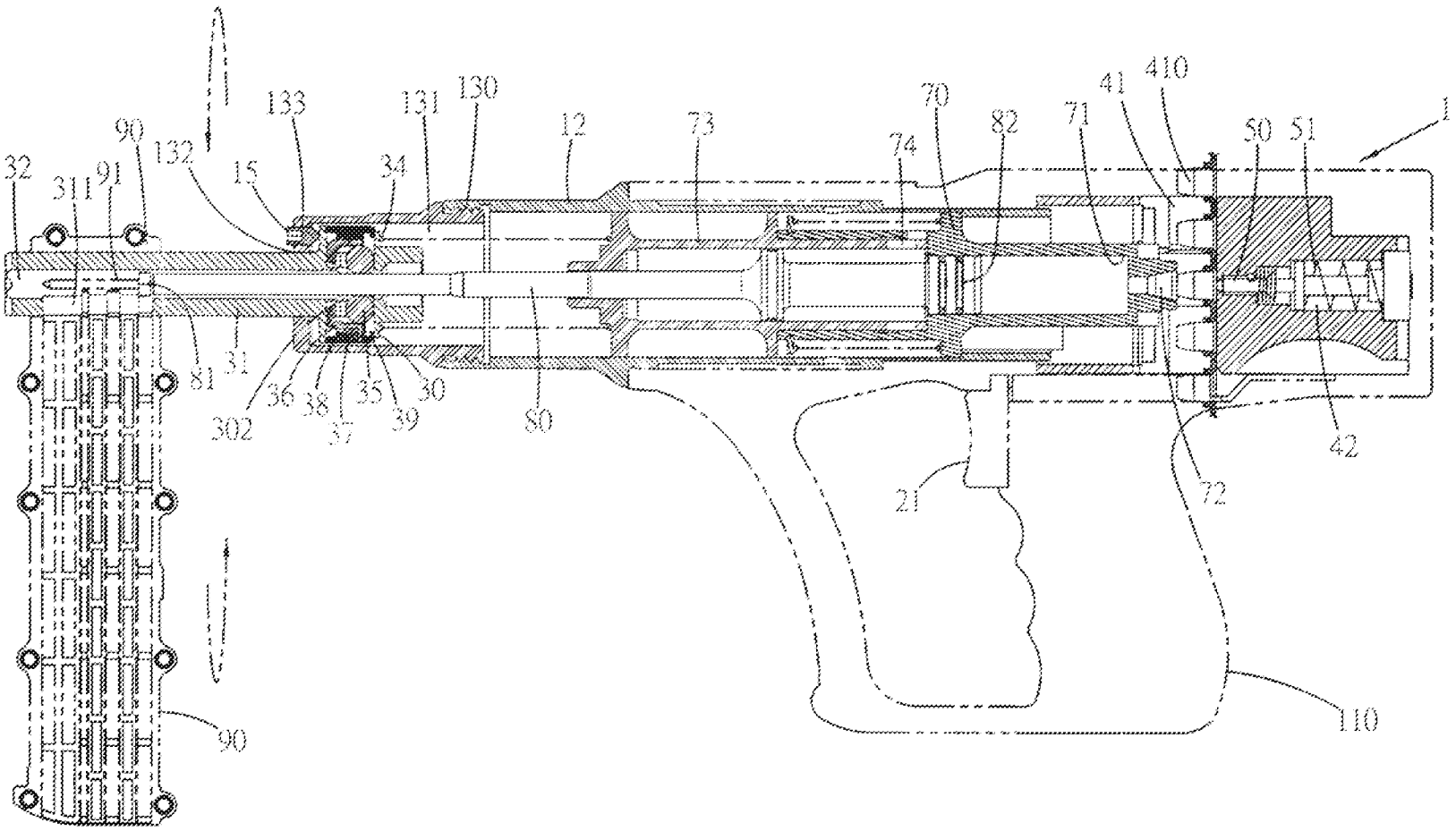
FIG. 7 shows that the position of the magazine is adjusted.

As shown in FIG. 7, when adjusting the magazine 90, the user moves the magazine 90 toward the direction of the grip 110, and the movement of the magazine 90 moves the base 30 in the room 131 so that the bores 303 are moved away from the adjustment member 15 in the threaded hole 133. In other words, the adjustment member 15 cannot engaged with the bores 303, so that the base 30 can be rotated a desired angle about the end hole 132 of the second tube 13. When the desired angle is reached, the adjustment member 15 is positioned to be aligned with one of the bores 303. The base 30 is then pushed by the spring 34 to engage the adjustment member 15 with the bore 303 corresponding to the adjustment member 15. Therefore, the magazine 90 and the nose 3 are able to be rotated in the room 131 of the second tube 13, and the angle between the magazine 90 and the grip 110 can also be adjusted.

Figure 8:
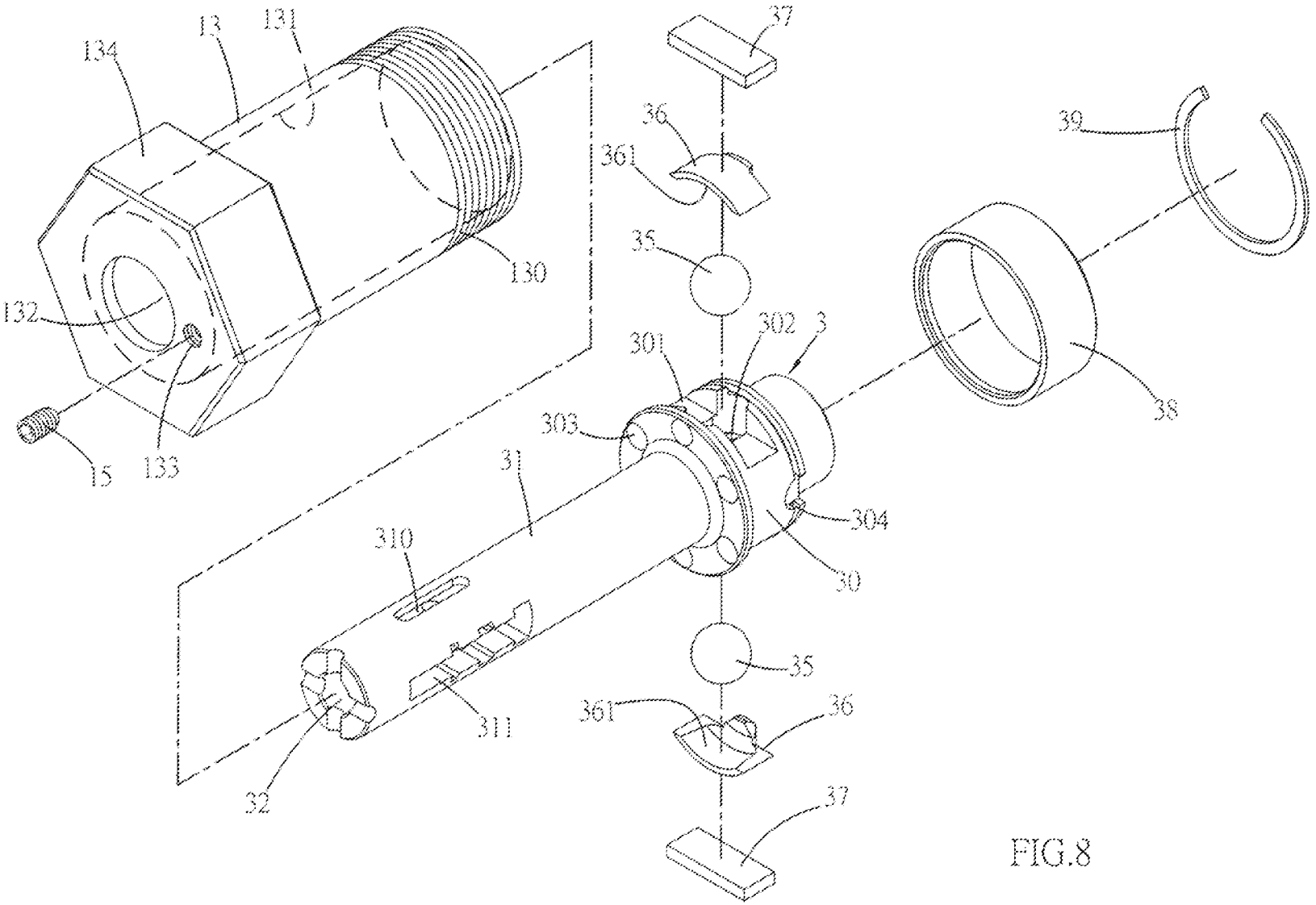
FIG. 8 is an exploded view of a second embodiment of the powder actuated nail gun of the present invention.

As shown in FIG. 8 which shows the second embodiment of the present invention, the difference from the previous embodiment is that the second tube 13 includes a polygonal portion 134 which can be clamped by a tool (not shown).

While we have shown and described the embodiment in accordance with the present invention, it should be clear to those skilled in the art that further embodiments may be made without departing from the scope of the present invention.

What is claimed is:

1. A powder actuated nail gun comprising:

a body having a grip formed to a rear end thereof, a trigger unit connected to the body and the grip, a barrel connected to the body, a first tube connected to a front end of the barrel of the body, a second tube connected to the first tube, a nose assembly axially extending through the second tube, the second tube having a threaded portion formed to an outer periphery thereof, the second tube including a room formed therein which communicates with an end hole defined in a front end of the second tube;

the nose assembly including a nose which is movably located in the room of the second tube, at least one ball located in the nose, at least one pressing member connected to the nose and pressing the at least one ball, a resilient member located on an outside of the at least one pressing member, a collar mounted to the nose and the resilient member located in an inner periphery of the collar, a clip connected to the nose and positioning the collar to the nose, the nose having a base which is movably and rotatably located in the room, the nose having a tubular member which movably and rotatably extends through the end hole of the second tube, a passage defined axially through the tubular member and the base, a strike rod movably extending through the passage, the strike rod including a piston which is movably received in a cylinder located in the body, the base having at least one recess in which the at least one pressing member is received, at least one elongate hole defined radially in the base and communicating with the passage, the at least one ball located in the at least one elongate hole, a groove defined in an outer periphery of the base and the clip engaged with the groove, the at least one ball contacting the strike rod, when the nose assembly is moved toward the grip, the at least one ball is pressed between the at least one pressing member and the strike rod so that the strike rod is co-moved with the nose assembly and the piston of the strike rod is moved to a ready-to-shoot position in the cylinder.

2. The powder actuated nail gun as claimed in claim 1, wherein a spring biases the base of the nose to keep the base to contact the front end of the second tube.

3. The powder actuated nail gun as claimed in claim 2, wherein a distance from an underside of one of two ends of the pressing member to an inner bottom of the elongate hole is longer than a distance from the underside of another one of the two ends of the pressing member to the inner bottom of the elongate hole.

4. The powder actuated nail gun as claimed in claim 3, wherein the base includes multiple bores defined in an end face thereof, an adjustment member is connected to a threaded hole defined in the front end of the second tube, the tubular member is adapted to be connected to a magazine, the adjustment member is engaged with one of the bores for positioning the magazine to the tubular member of the nose.

5. The powder actuated nail gun as claimed in claim 4, wherein the underside of the pressing member is an inclined underside.

6. The powder actuated nail gun as claimed in claim 5, wherein the tubular member has at least one positioning slot which is adapted to be connected with the magazine, the tubular member has an entrance for introducing nails in the magazine into the passage of the tubular member.

7. The powder actuated nail gun as claimed in claim 6, wherein the second tube includes a polygonal portion which is adapted to be engaged with a tool.

8. The powder actuated nail gun as claimed in claim 4, wherein the elongate hole includes a wide opening defined in an outer periphery of the base and a narrow portion formed in the base, or the elongate hole includes a tapered inner portion.

9. The powder actuated nail gun as claimed in claim 8, wherein the tubular member has at least one positioning slot which is adapted to be connected with the magazine, the tubular member has an entrance for introducing nails in the magazine into the passage of the tubular member.

10. The powder actuated nail gun as claimed in claim 9, wherein the second tube includes a polygonal portion which is adapted to be engaged with a tool.

* * * * *